US005894951A

United States Patent [19]

Hunt

[11] Patent Number: 5,894,951

[45] Date of Patent: Apr. 20, 1999

[54] BASKETBALL STORAGE DEVICE

[76] Inventor: Ricardo Hunt, 2316 Camden Cir., Valdosta, Ga. 31602

[21] Appl. No.: 08/858,355

[22] Filed: May 19, 1997

[51] Int. Cl.[6] ..... B65D 25/22

[52] U.S. Cl. ..... 220/475; 220/527; 206/315.9

[58] Field of Search ..... 220/475, 480, 220/481, 507, 527, 554; 206/457, 315.9; 312/49; 211/14, 34

[56] References Cited

U.S. PATENT DOCUMENTS

| | | | |
|---|---|---|---|
| 1,877,099 | 9/1932 | Wattman | 220/475 |
| 2,828,176 | 3/1958 | Burgh | 220/554 |
| 3,136,398 | 6/1964 | Platt | 206/315.9 |
| 4,860,909 | 8/1989 | Leumi | 220/475 |
| 5,067,626 | 11/1991 | Leumi | 220/475 |
| 5,553,707 | 9/1996 | Lion | 206/315.9 |

FOREIGN PATENT DOCUMENTS

| | | | |
|---|---|---|---|
| 809 947 | 3/1937 | France | 220/475 |
| 296 835 | 9/1928 | United Kingdom | 312/49 |

*Primary Examiner*—Stephen J. Castellano
*Attorney, Agent, or Firm*—Michael I. Kroll

[57] ABSTRACT

A basketball storage device (12) for a basket assembly (14) having a stanchion (16) extending upwardly from a court floor (18), a support member (20) on a top end of the stanchion (16), a backboard (22) affixed to the support member (20), a rim (24) attached to the backboard (22) and a net (26) hanging down from the rim (24). The basketball storage device (12) comprises a container (28) for holding at least one basketball (30) therein. A structure (32) is for attaching the container (28) in a vertical position to the stanchion (16) of the basket assembly (14), so that the at least one basketball (30) is available to be utilized in a basketball game.

16 Claims, 9 Drawing Sheets

BASKETBALL STORAGE DEVICE

BACKGROUND OF THE INVENTION

1. Field of the Invention

The instant invention relates generally to sports equipment and more specifically it relates to a basketball storage device. The basketball storage device is mounted to a basket assembly stanchion, to retain basketballs therein for use in a basketball game.

2. Description of the Prior Art

Numerous sports equipment have been provided in prior art that are adapted to be utilized when playing various types of sports. While these units may be suitable for the particular purpose to which they address, they would not be as suitable for the purposes of the present invention as heretofore described.

SUMMARY OF THE INVENTION

A primary object of the present invention is to provide a basketball storage device that will overcome the shortcomings of the prior art devices.

Another object is to provide a basketball storage device that is mounted to a stanchion of a basket assembly to retain a plurality of basketballs which can be used during a basketball game.

An additional object is to provide a basketball storage device in which a basketball container having a hinged door is mounted by at least one clamp to the stanchion that can be vertical or at an angle, so that the basketballs can be conveniently stored within the basketball container for future use for a basketball game.

A further object is to provide a basketball storage device that is simple and easy to use.

A still further object is to provide a basketball storage device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
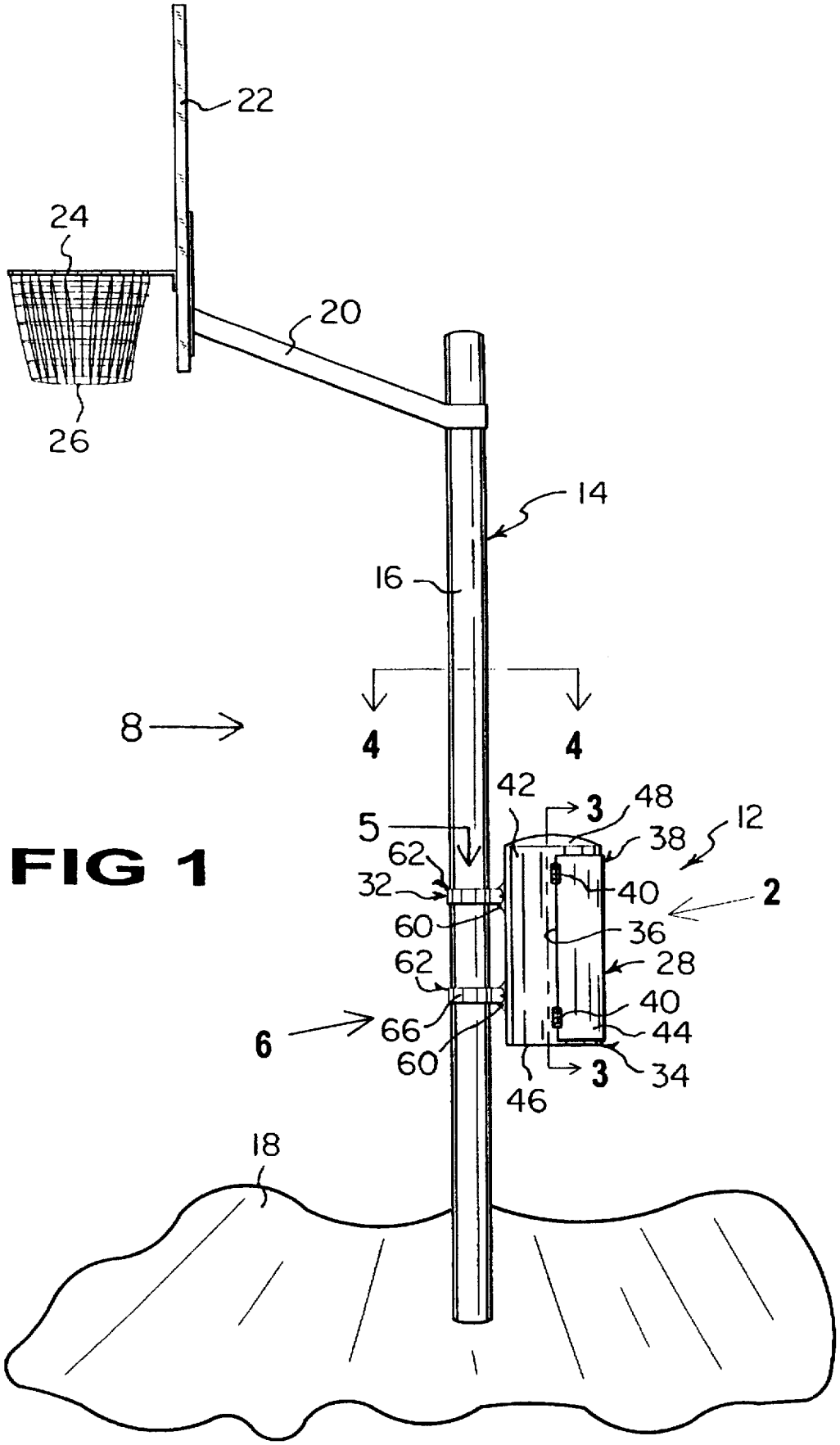
FIG. 1 is a side view showing a first embodiment of the instant invention mounted to a vertical stanchion of a basket assembly.
Figure 2:
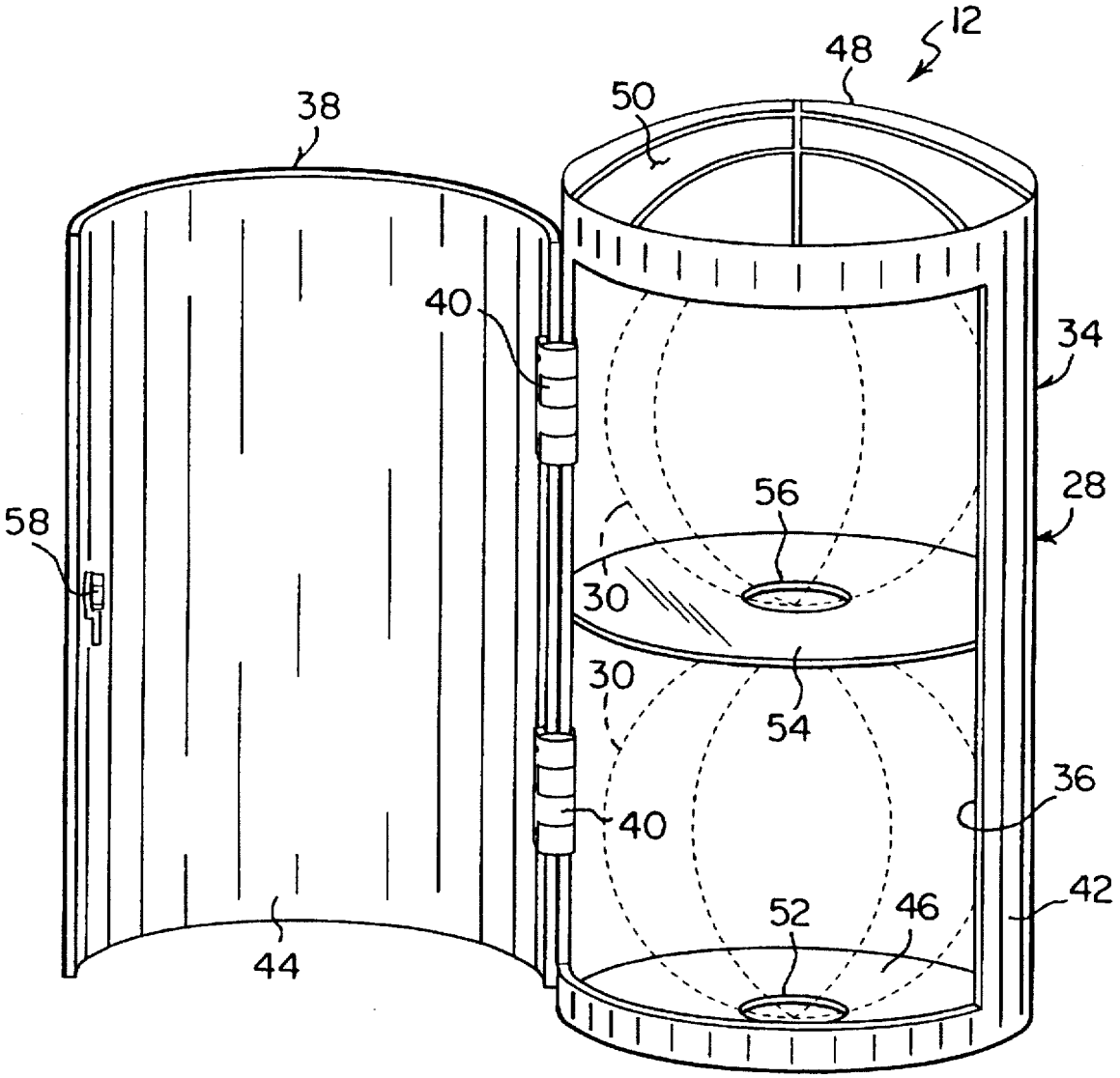
FIG. 2 is an enlarged perspective view taken in the direction of arrow 2 in FIG. 1, with the curved door opened and the basket assembly removed therefrom.
Figure 3:
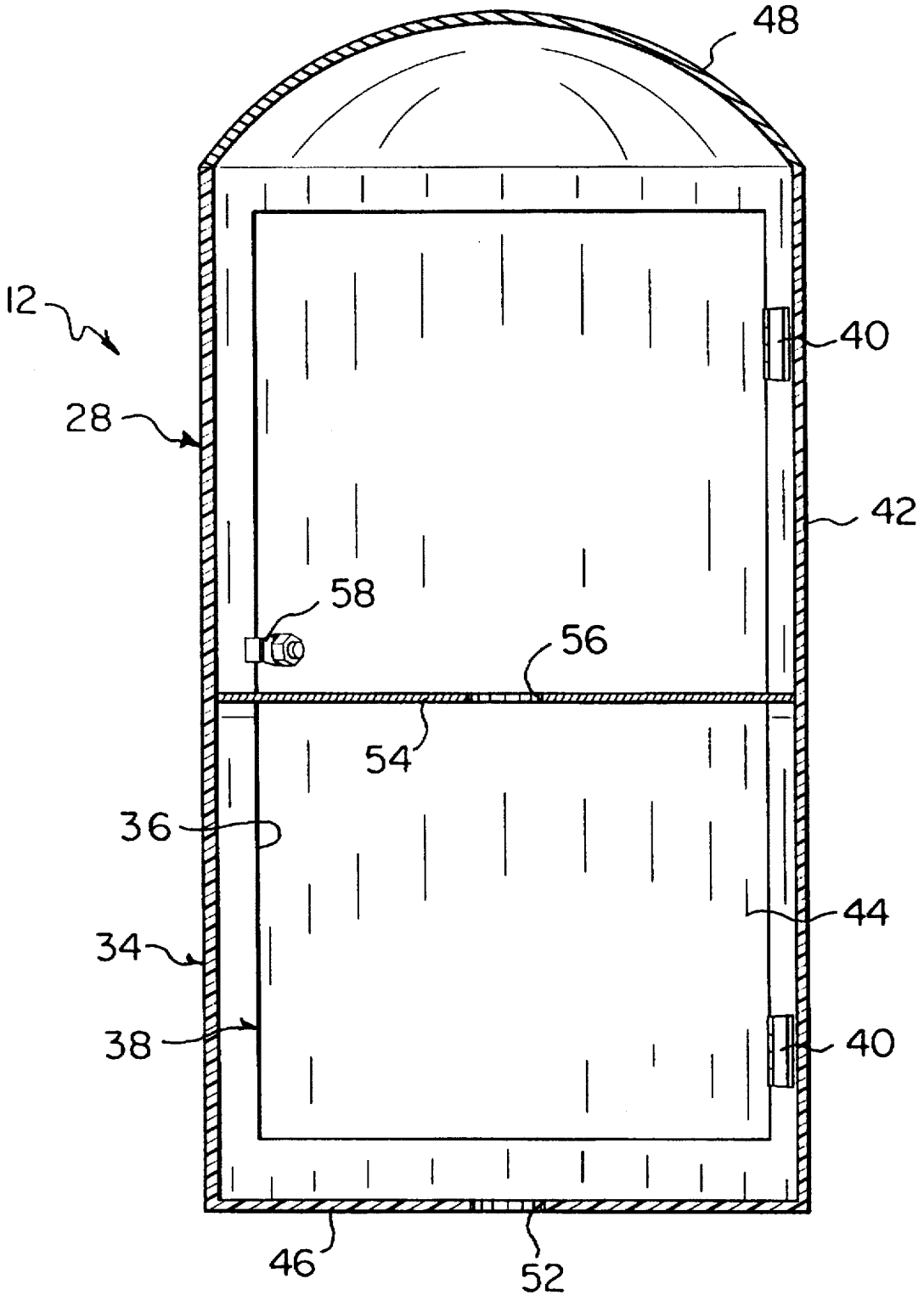
FIG. 3 is an enlarged cross sectional view taken along line 3—3 in FIG. 1.
Figure 5:
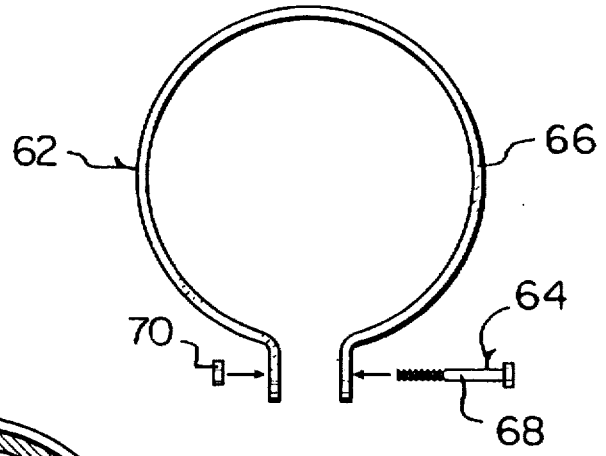
FIG. 5 is an enlarged top view of one mounting clamp per se taken in the direction of arrow 5 in FIG. 1, with the bolt and nut exploded therefrom.
Figure 4:
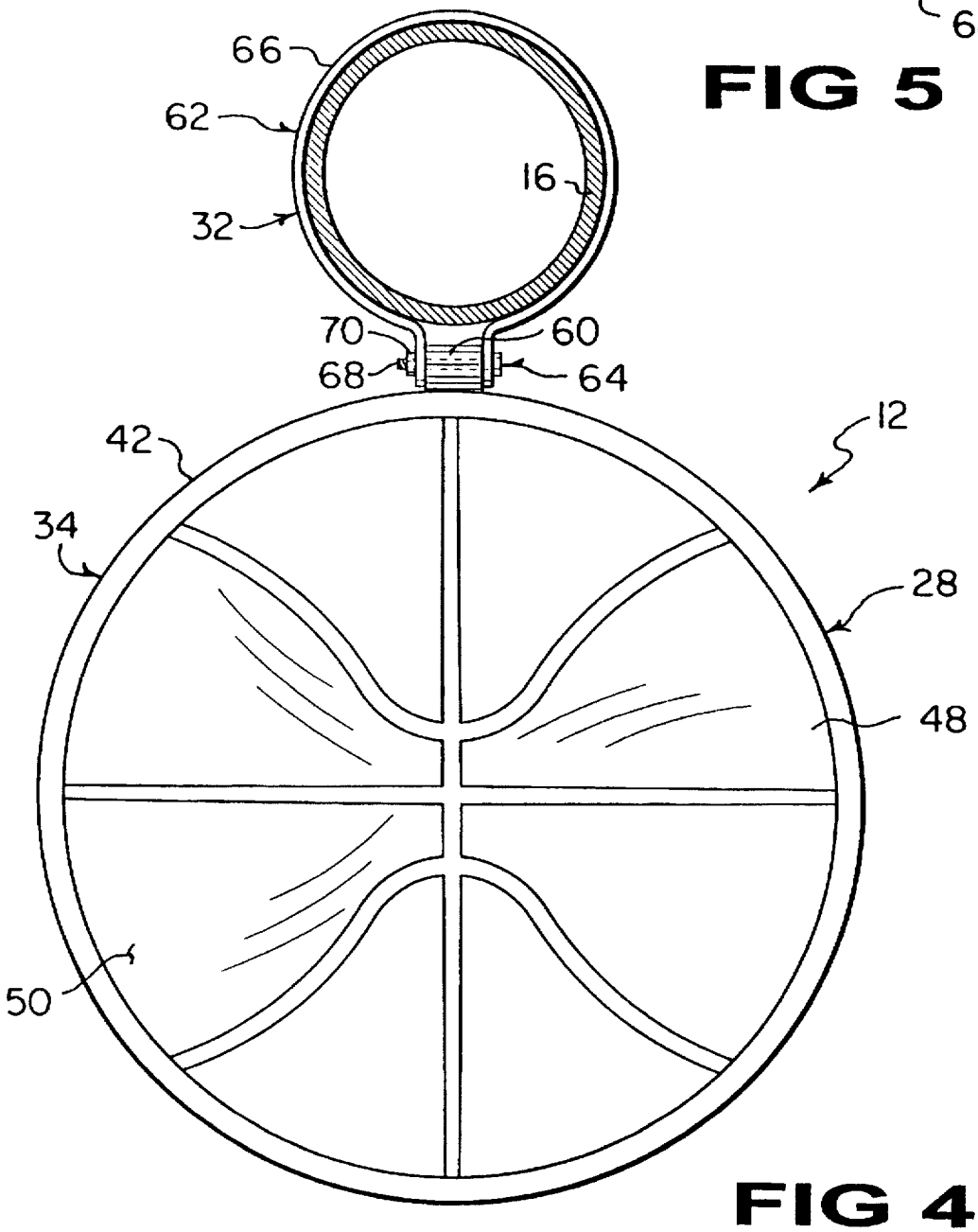
FIG. 4 is an enlarged cross sectional view taken along line 4—4 in FIG. 1.
Figure 6:
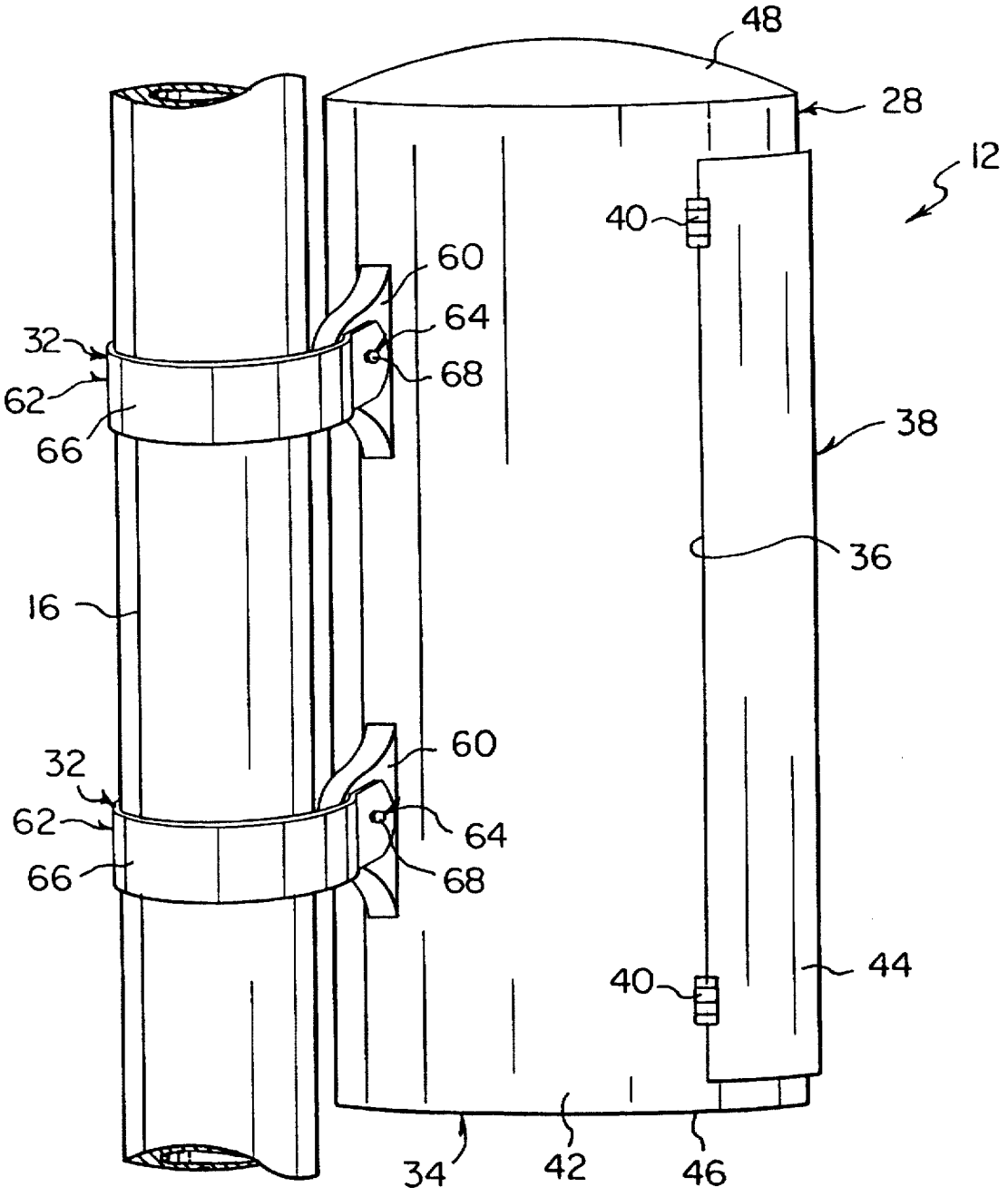
FIG. 6 is an enlarged perspective view taken in the direction of arrow 6 in FIG. 1, with the vertical stanchion broken away.

Turning now descriptively to the drawings, in which similar reference characters denote similar elements throughout the several views, FIGS. 1 through 10 illustrate a basketball storage device 12 of the present invention. With regard to the reference numerals used, the following numbering is used throughout the various drawing figures.

12 basketball storage device
14 basket assembly
16 stanchion of 14
18 court floor
20 support member of 14
22 backboard of 14
24 rim of 14
26 net of 14
28 container of 12
30 basketball
32 attaching structure of 12
34 housing of 28
36 opening in 34
38 door of 28
40 hinge of 38
42 cylindrical body for 34
44 curved plate of 38
46 flat bottom wall of 42
48 dome top wall of 42
50 simulated basketball design on 48
52 small central aperture in 46
54 shelf in 42
56 small central aperture in 54
58 lock latch mechanism on 44
60 mounting lug of 32 on 28
62 mounting clamp of 32
64 fasteners of 32
66 collar grip for 62
68 locking bolt of 64
70 nut of 64
72 mounting clamp of 32
74 padded base of 16
76 angular collar grip for 72

The basketball storage device 12 is for a basket assembly 14 having a stanchion 16 extending upwardly from a court floor 18, a support member 20 on a top end of the stanchion 16, a backboard 22 affixed to the support member 20, a rim 24 attached to the backboard 22 and a net 26 hanging down from the rim 24. The basketball storage device 12 comprises a container 28 for holding at least one basketball 30 therein. A structure 32 is for attaching the container 28 in a vertical position to the stanchion 16 of the basket assembly 14, so that the at least one basketball 30 is available to be utilized in a basketball game.

The container 28 consists of a housing 34 having a side opening 36. A door 38 is hinged at 40 to the side opening 36 of the housing 34. When the door 38 is opened, the at least one basketball 30 can be placed therein and removed therefrom when the need arises. The housing 34 is a cylindrical body 42, while the door 38 is a curved plate 44, to match up with the cylindrical body 42 when closed onto the side opening 36. The cylindrical body 42 includes a flat bottom wall 46 and a dome top wall 48. The dome top wall 48 can contain a simulated basketball design 50 thereon.

The flat bottom wall 46 has a small central aperture 52. A shelf 54 is provided and has a small central aperture 56 and is horizontally located midway within the cylindrical body 42. Two basketballs 30 can be placed therein, a first basketball 30 on the small central aperture 52 of the flat bottom wall 46 and a second basketball 30 on the small central aperture 56 of the shelf 54. The curved plate 44 includes a lock latch mechanism 58, to keep the curved plate 44 closed to the cylindrical body 42.

The attaching structure 32, as shown in FIGS. 1, 4, 5, 6 and 8, consists of a pair of longitudinally spaced apart mounting lugs 60 on the container 28. A pair of mounting clamps 62 are provided. Fasteners 64 are for securing the mounting clamps 62 about the stanchion 16 and to the mounting lugs 60, when a bottom end of the stanchion 16 is vertically affixed to the court floor 18. The mounting clamps 62 are collar grips 66, while the fasteners 64 are locking bolts 68 with nuts 70.

Figure 7:
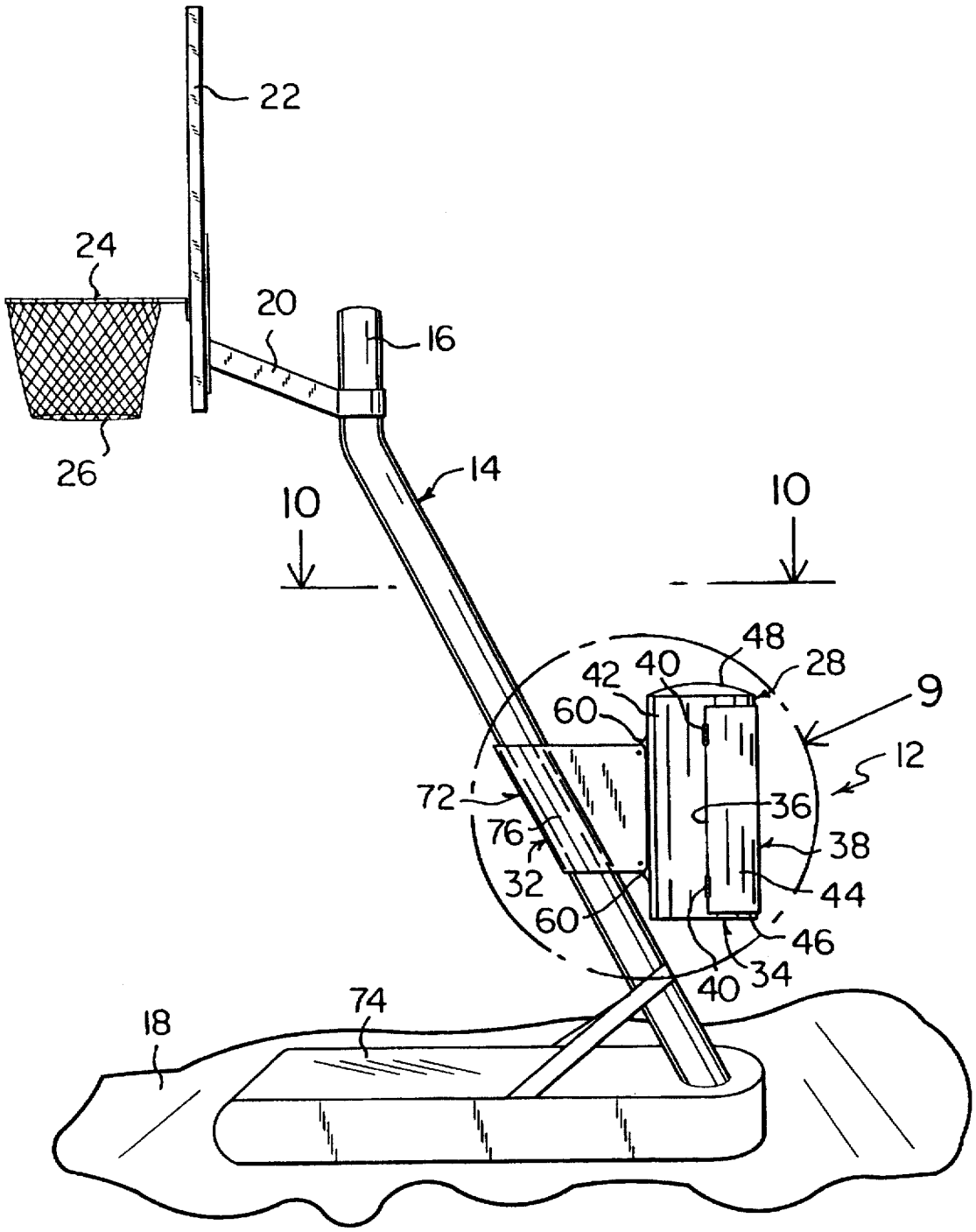
FIG. 7 is a side view showing a second embodiment of the instant invention mounted to an angled stanchion of a basket assembly.
Figure 8:
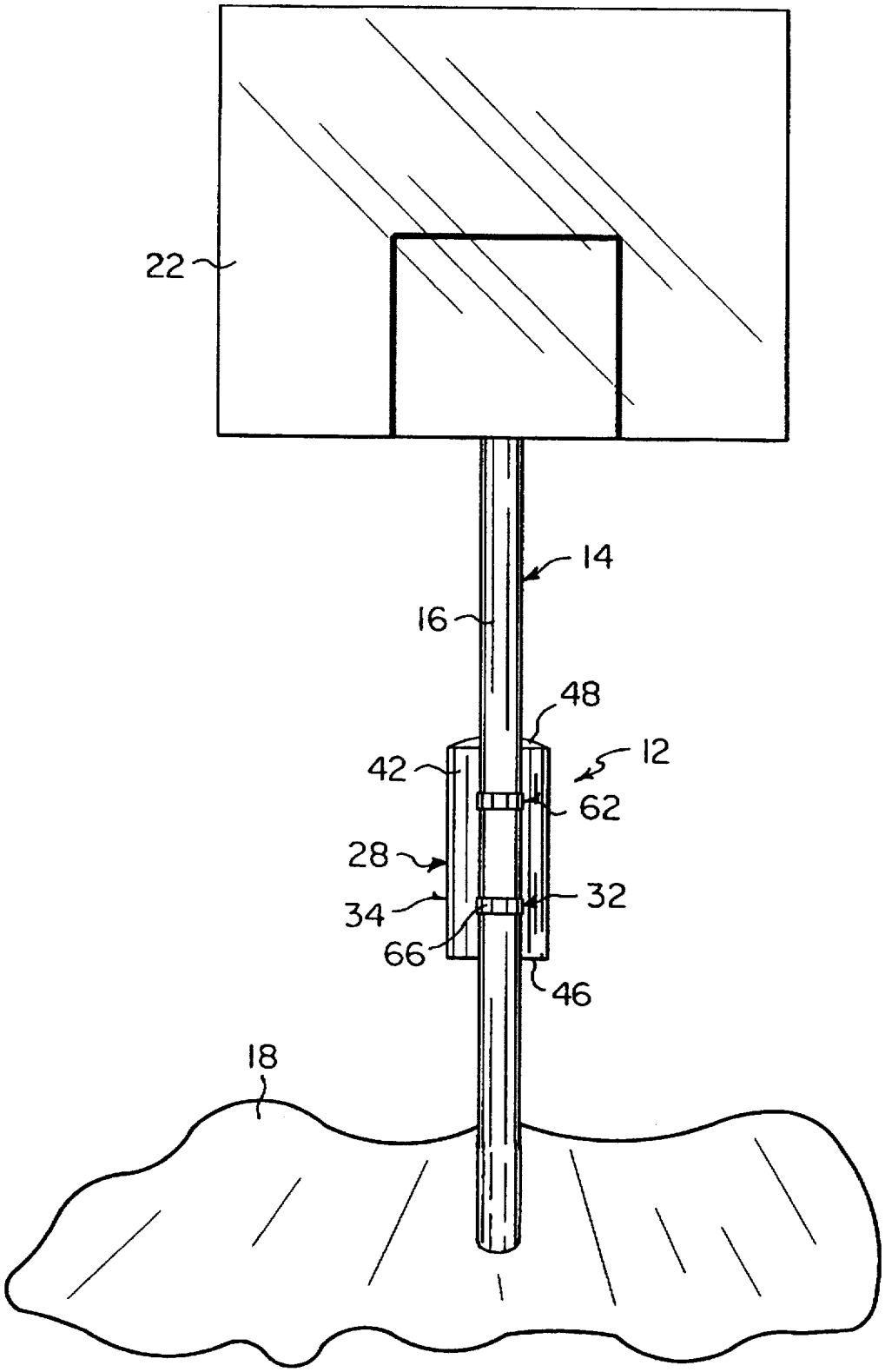
FIG. 8 is a front view taken in the direction of arrow 8 in FIG. 1.
Figure 9:
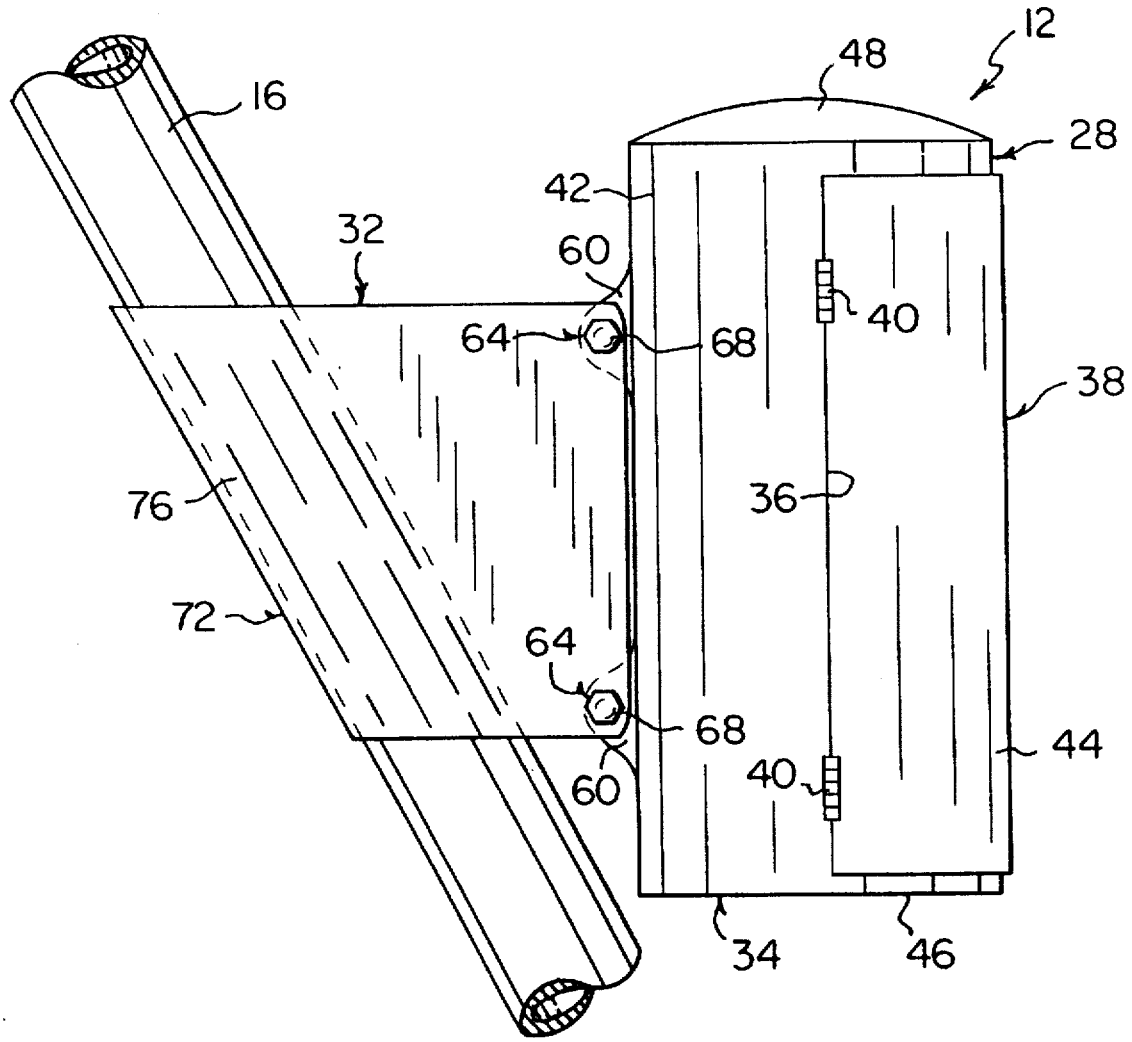
FIG. 9 is an enlarged side view of an area indicated by arrow 9 in FIG. 7.
Figure 10:
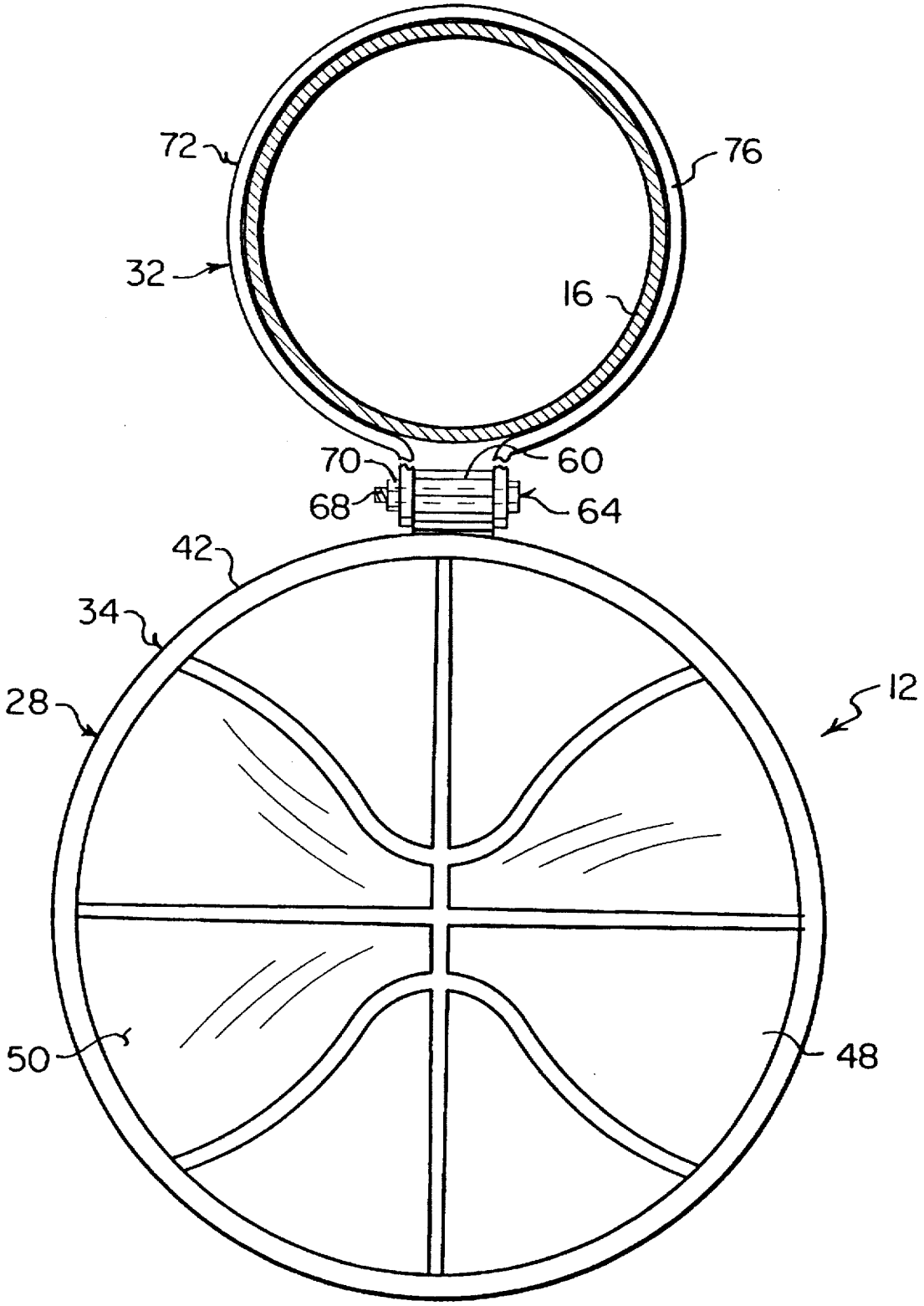
FIG. 10 is an enlarged cross section view taken along line 10—10 in FIG. 7, with part of the mounting clamp broken away.

The attaching structure 32, as shown in FIGS. 7, 9 and 10, comprises the pair of longitudinally spaced apart mounting lugs 60 on the container 28. A mounting clamp 72 is provided. The fasteners 64 are for securing the mounting clamp 72 about the stanchion 16 and to the mounting lugs 60. the stanchion 16 includes a padded base 74 which sits upon the court floor 18, while a bottom end of the stanchion 16 is angularly affixed to the padded base 74. The mounting clamp 72 is an angular collar grip 76, while the fasteners 64 are the locking bolts 68 and nuts 70.

OPERATION OF THE INVENTION

To install the basketball storage device the following steps should be taken:

1. Place the two mounting clamps 62 being the collar grips 66 about the stanchion 16, if the stanchion 16 is vertical.
2. Attach the fasteners 64 being the locking bolts 68 and nuts 70 through the collar grips 66 and the mounting lugs 60 on the container 28.
3. Place the mounting clamp 72 being the angular collar grip 76 about the stanchion 16, if the stanchion 16 is angularly affixed to the padded base 74.
4. Attach the fasteners 64 being the locking bolts 68 and nuts 70 through the angular collar grip 76 and the mounting lugs 60 on the container 28.
5. Make sure that the container 28 is facing rearwardly from the rim 24 and net 26 on the backboard 22.
6. Open the door 38 and place the basketballs 30 within the container 28, so that they can be utilized during a basketball game.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A basketball storage device for a basket assembly having a stanchion extending upwardly from a court floor, a support member on a top end of the stanchion, a backboard affixed to the support member, a rim attached to the backboard and a net hanging down from the rim, said basketball storage device comprising:

a) a container for holding at least one basketball therein; and b) means for attaching said container in a vertical position to the stanchion of the basket assembly, so that the at least one basketball is available to be utilized in a basketball game and wherein said attaching means includes:

i) a pair of longitudinally spaced apart mounting lugs on said container;

ii) a pair of mounting clamps; and iii) fasteners for securing said mounting clamps about the stanchion and to said mounting lugs, when a bottom end of the stanchion is vertically affixed to the court floor.

2. A basketball storage device as recited in claim 1, wherein said mounting clamp is an angular collar grip, while said fasteners are locking bolts and nuts.

3. A basketball storage device for a basket assembly having a stanchion extending upwardly from a court floor, a support member on a top end of the stanchion, a backboard affixed to the support member, a rim attached to the backboard and a net hanging down from the rim, said basketball storage device comprising:

a) a container for holding at least one basketball therein including a housing having a side opening and a door hinged at said side opening of said housing, so that when said door is opened the at least one basketball can be placed therein and removed therefrom when the need arises; and b) means for attaching said container in a vertical position to the stanchion of the basket assembly, so that the at least one basketball is available to be utilized in a basketball game, wherein said housing is a cylindrical body having a flat bottom wall and a dome top wall including a simulated basketball design thereon and said door is a curved plate to match with said cylindrical body when closed onto said side opening.

4. A basketball storage device as recited in claim 3, wherein said curved plate includes a lock latch mechanism to keep said curved plate closed to said cylindrical body.

5. A basketball storage device as recited in claim 3, wherein said attaching means includes:

a) a pair of longitudinally spaced apart mounting lugs on said container;

b) a pair of mounting clamps; and c) fasteners for securing said mounting clamps about the stanchion and to said mounting lugs, when a bottom end of the stanchion is vertically affixed to the court floor.

6. A basketball storage device as recited in claim 5, wherein said mounting clamps are collar grips, while said fasteners are locking bolts with nuts.

7. A basketball storage device as recited in 3, further including:

a) said flat bottom wall having a small central aperture; and b) a shelf having a small central aperture and being horizontally located midway within said cylindrical body, so that two basketballs can be placed therein, a first basketball on said small central aperture of said flat bottom wall and a second basketball on said small central aperture of said shelf.

8. A basketball storage device as recited in claim 7, wherein said curved plate includes a lock latch mechanism to keep said curved plate closed to said cylindrical body.

9. A basketball storage device as recited in claim 8, wherein said attaching means includes:

a) a pair of longitudinally spaced apart mounting lugs on said container;

b) a pair of mounting clamps; and c) fasteners for securing said mounting clamps about the stanchion and to said mounting lugs, when a bottom end of the stanchion is vertically affixed to the court floor.

10. A basketball storage device as recited in claim 9, wherein said mounting clamps are collar grips, while said fasteners are locking bolts with nuts.

11. A basketball storage device as recited in 8, wherein said attaching means includes:

a) a pair of longitudinally spaced apart mounting lugs on said container;

b) a mounting clamp; and c) fasteners for securing said mounting clamp about the stanchion and to said mounting lugs, when the stanchion includes a padded base which sits upon the court floor, while a bottom end of the stanchion is angularly affixed to the padded base.

12. A basketball storage device as recited in claim 11, wherein said mounting clamp is an angular collar grip, while said fasteners are locking bolts and nuts.

13. A basketball storage device for a basket assembly having a stanchion extending upwardly from a court floor, a support member on a top end of the stanchion, a backboard affixed to the support member, a rim attached to the backboard and a net hanging down from the rim, said basketball storage device comprising:

a) a container for holding at least one basketball therein including a housing having a side opening and a door hinged at said side opening of said housing, so that when said door is opened the at least one basketball can be placed therein and removed therefrom when the need arises; and b) means for attaching said container in a vertical position to the stanchion of the basket assembly, so that the at least one basketball is available to be utilized in a basketball game, wherein said housing is a cylindrical body having a flat bottom wall having a small central aperture, a dome top wall and a shelf having a small central aperture and being horizontally located midway within said cylindrical body, so that two basketballs can be placed therein, a first basketball on said small central aperture of said flat bottom wall and a second basketball on said small central aperture of said shelf, and wherein said door is a curved plate to match with said cylindrical body when closed onto said side opening.

14. A basketball storage device as recited in claim 13, wherein said curved plate includes a lock latch mechanism to keep said curved plate closed to said cylindrical body.

15. A basketball storage device as recited in claim 13, wherein said attaching means includes:

a) a pair of longitudinally spaced apart mounting lugs on said container;

b) a pair of mounting clamps; and c) fasteners for securing said mounting clamps about the stanchion and to said mounting lugs, when a bottom end of the stanchion is vertically affixed to the court floor.

16. A basketball storage device as recited in claim 15, wherein said mounting clamps are collar grips, while said fasteners are locking bolts with nuts.

* * * * *